US005516015A

United States Patent [19]

Berzins et al.

[11] Patent Number: 5,516,015

[45] Date of Patent: May 14, 1996

[54] PORTABLE FOLDING BOOT JACK

[76] Inventors: Vilis Berzins, 821 Acoma, Denver, Colo. 80204; Mart S. Shannon, 7040 E. Girard, Apt. 407, Denver, Colo. 80224

[21] Appl. No.: 349,197

[22] Filed: Dec. 5, 1994

[51] Int. Cl.[6] ..... A47G 25/80

[52] U.S. Cl. ..... 223/115; 223/114

[58] Field of Search ..... 223/111, 113, 223/114, 115, 116, 117, 120

[56] References Cited

U.S. PATENT DOCUMENTS

| | | | |
|---|---|---|---|
| 544,063 | 8/1895 | Jacks | 223/115 |
| 1,274,500 | 8/1918 | Bell | 223/115 |
| 1,893,280 | 1/1933 | Gerfen | 223/114 |

FOREIGN PATENT DOCUMENTS

| | | | |
|---|---|---|---|
| 3031934 | 5/1982 | Germany | 223/114 |
| 2144969 | 12/1984 | United Kingdom | 223/114 |

*Primary Examiner*—C. D. Crowder
*Assistant Examiner*—Bibhu Mohanty
*Attorney, Agent, or Firm*—Edwin H. Crabtree; Donald W. Margolis; Ramon L. Pizarro

[57] ABSTRACT

A portable folding boot jack for removing different size boots and other types of footware. The boot jack includes a first and a second boot engaging member. The first and second boot engaging members have a first end hinged on top of an upright support. The upright support acts as a fulcrum for pivoting the boot jack and holding the boot engaging members at an angle from the horizontal. The first boot engaging member has a second end with a first opening therein. The second end of the first boot heal engaging member includes a pair of arms on opposite sides of the first opening for gripping a rear portion of the boot when the rear of the boot is received inside the opening. The second boot engaging member has a second end with a second opening therein. The first opening is larger than the second opening. The second end of the second boot engaging member includes a pair of arms on opposite sides of the second opening for gripping rear portion of a smaller boot when the rear of the boot is received inside the opening. The second boot member includes an upright support and frame cavity for receiving the upright support and a frame of a lower portion of the first boot member in a nesting relationship when the boot jack is folded in half and no longer in use.

12 Claims, 1 Drawing Sheet

PORTABLE FOLDING BOOT JACK

BACKGROUND OF INVENTION (a) Field of the Invention

This invention relates to boot jacks and more particularly, butnot by way of limitation, to a boot jack that is compact, foldable, portable and can be used for engaging and removing different size boots.

(b) Discussion of Prior Art

Heretofore there have been a variety of different types of boot jacks which are foldable and held upright by a center support. These boot jacks are described in U.S. Pat. Nos. 174,433 to Phenix, 1,849,282 to Churchill, 1,893,280 to Gerfen, 2,280,251 to Mirski and 4,226,346 to Turner.

While some of the above mentioned patents have some of the individual features of the subject invention, none of them incorporate the unique combination of structure and function of the subject portable folding boot jack as described herein.

SUMMARY OF THE INVETION

In view of the foregoing, it is a primary object of the present invention to provide a lightweight, inexpensive boot jack that is rugged in construction and can be used for engaging and removing different size boots and other types of footware. One end of the boot jack is adapted for receiving a rear portion of one size of boot and another end of the boot jack is adapted for receiving a rear portion of a different size of boot.

Another object of the invention is to provide a boot jack that is portable and can be quickly folded for storage and travel and unfolded when used in removing a pair of boots.

Still another object of the invention is to provide a boot jack wherein an upright support and one end of the boot jack are neatly folded and received inside another end of the boot jack in a nesting relationship for providing a compact unit when carrying, storing and traveling.

Yet another object of the subject boot jack is its adaptability for use in different types of boots such as Western, English riding, fashion, work and other types boots along with different kinds of footware.

The subject boot jack includes a first and a second boot engaging member. The first and second boot engaging members have a first end hinged on top of an upright support. The upright support acts as a fulcrum for pivoting the boot jack and holding the boot engaging members at an angle from the horizontal. The first boot engaging member has a second end with a first opening therein. The second end of the first boot engaging member includes a pair of arms on opposite sides of the first opening for gripping a rear portion of the boot when the rear of the boot is received inside the opening. The second boot engaging member has a second end with a second opening therein. The first opening is larger than the second opening. The second end of the second boot engaging member includes a pair of arms on opposite sides of the second opening for gripping rear portion of a smaller boot when the rear of the boot is received inside the opening. The second boot member includes a bottom portion with a second frame with an upright support and frame cavity therein for receiving the upright support and a first frame in a bottom portion of the first boot member in a nesting relationship when the boot jack is folded in half and no longer in use.

These and other objects of the present invention will become apparent to those familiar with boot jacks from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
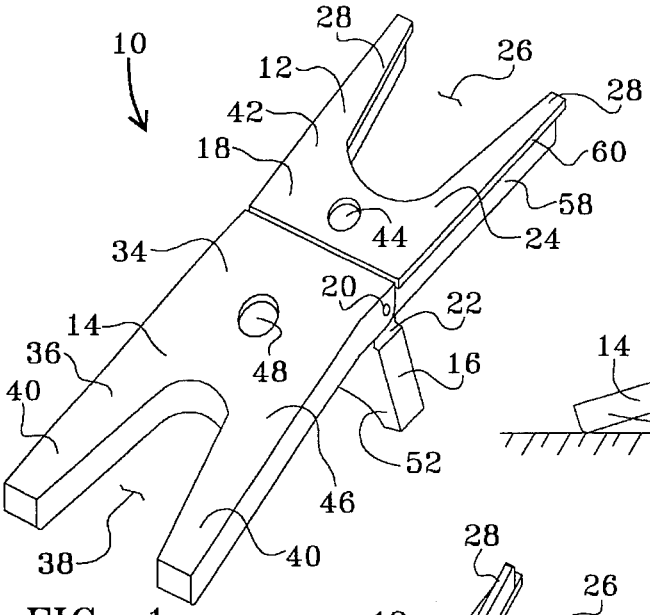
FIG. 1 is a perspective view of the subject portable folding boot jack in an unfolded position ready for use in removing a pair of boots.

In FIG. 1, a perspective view of the subject portable folding boot jack is shown having a general reference numeral 10. Broadly the boot jack 10 includes a first boot engaging member 12, a second boot engaging member 14 and an upright support 16. The upright support 16 acts as a fulcrum for pivoting the boot jack 10 on a flat ground surface and holding the boot engaging members 14 and 16 upwardly at an angle from the horizontal.

Figure 5:
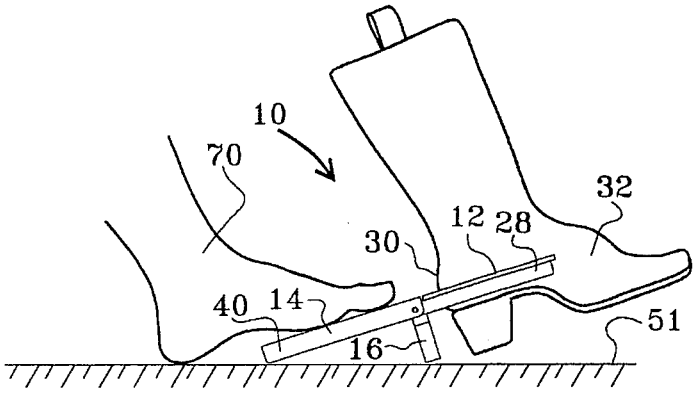
FIG. 5 is a front view of the boot jack in an unfolded position and with a first boot engaging member griping a rear portion of a boot to remove the boot. A human foot is shown in this drawing received on top of a second boot engaging member for holding the boot jack in place.

The first boot engaging member 12 includes a first end 18 which is hinged by a hinge pin 20 on an upper portion 22 of the upright support 16. The first engaging member 12 further includes a second end 24 with a first opening 26 with a pair of boot gripping arms 28 on opposite sides of the opening 26 for engaging and gripping a rear portion 30 of a boot 32. The opening 26 may be "V" shaped, "U" shaped or similar configurations. The boot 32 and rear portion 30 are shown in FIG. 5. While boot 32 is shown in the drawings, it can be appreciated that the subject boot jack 10 can be used equally well with other types of footwear.

The second boot engaging member 14 includes a first end 34 which is hinged by the hinge pin 20 on the upper portion 22 of the upright support 16. The second engaging member 14 further includes a second end 36 with a second opening 38 with a pair of boot gripping arms 40 on opposite sides of the opening 38 for engaging and gripping the rear portion of a boot. The second opening 38 is smaller by design for gripping smaller size boots when compared to the first opening 26 of the first boot engaging member 12. The second opening may also be "V" shaped, "U" shaped or similar configurations.

Figure 3:
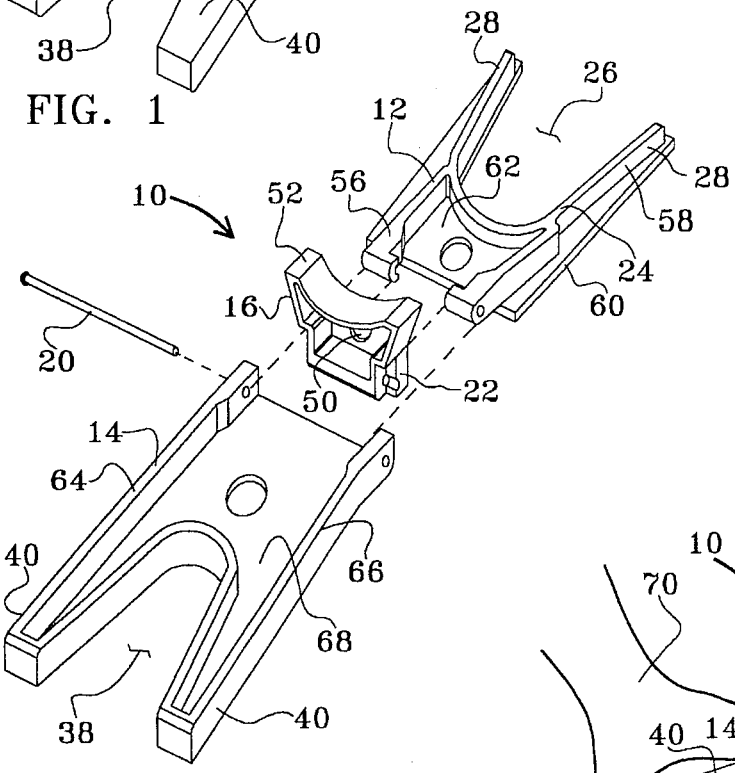
FIG. 3 is an exploded perspective view of the boot jack with the boot jack turned upside down from the perspective view shown in FIG. 1.
Figure 4:
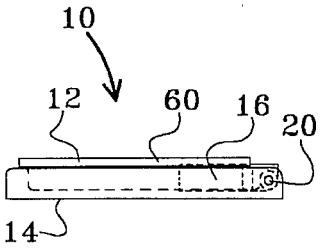
FIG. 4 is a front view of the boot jack in a folded position ready for storage or travel.

The first boot engaging member 12 includes a flat upper surface 42 and a hole 44 therethrough. Also, the second boot engaging member 14 includes a flat upper surface 46 and a hole 48 therethrough. The upright support 16, as shown in FIG. 3, also includes a hole 50. The holes 44, 48 and 50 are used for receiving a display peg therethrough when the boot jack 10 is folded as shown in FIG. 4. The display peg is not shown in the drawings and obviously would be used for suspending the boot jack 10 prior to purchase by a customer or the peg can be used by the user of the boot jack 10 when it is stored.

Figure 2:
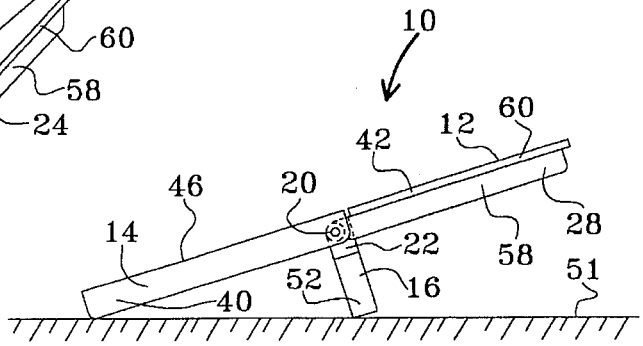
FIG. 2 is a front view of the boot jack in an unfolded position.

In FIG. 2, a front view of the boot jack 10 is shown with the second boot engaging member 14 and gripping arms 40 resting on a flat surface 51. Also a lower portion 52 of the upright support 16 iS resting on the flat surface 51. The first boot engaging member 12 with gripping arms 28 are extending upwardly from the horizontal and in position for receiving the rear portion 30 of the boot 32.

In FIG. 3, an exploded perspective view of the bottom of the boot jack 10 is illustrated. A bottom portion 56 of the first boot engaging member 12 includes a first frame 58 with lips 60 on opposite sides of the frame 58. The bottom portion 56 also includes an upright support cavity 62 contoured for receiving the upright support 16 when the boot jack 10 is folded. A bottom portion 64 of the second boot engaging member 14 includes a second frame 66. The bottom portion 64 also includes an upright support and frame cavity 68 contoured for receiving the upright support 16 and the first frame 58 of the first boot engaging member 12 in a nesting relationship when the boot jack 10 is folded together.

FIG. 4 illustrates a front view of the boot jack 10 when it is folded. When the boot jack 10 is ready for storage, display or travel, the first boot engaging member 12 is folded downwardly with upright support 16 received inside the upright support cavity 62 shown in FIG. 3. The folding continues as the first frame 58 of the first boot engaging member 12 and upright support 16 are folded and received inside the upright support and frame cavity 68. As seen in FIG. 4, the boot jack 10 makes for a compact unit when folded in half as shown.

FIG. 5 shows a front view of the boot jack 10 with the first boot engaging member 12 extending upwardly from the flat surface 51 with the rear portion 30 of the boot 32 received in the first opening 26 and the gripping arms 28 engaging the rear portion 30 for removing the boot 32. In this view, a human foot 70 is placed on the flat upper surface 42 of the second boot engaging member 14 for holding the boot jack 10 in place on the flat surface 51.

If it is desired to remove a small boot, such as a ladies's boot or child's boot and other types of footware, the boot jack 10 can be quickly pivoted on the upright support 16 with the second boot engaging member 14 extending upwardly from the horizontal and the first boot engaging member 12 resting on the flat surface 51. In this example, a rear portion of the smaller boot would be received inside the second opening 38. At this time, the boot gripping arms 40 would be used to engage the rear portion of the boot and thus remove the smaller boot.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A portable foldable boot jack for removing different size boots and other footware, the boot jack comprising:

a first boot engaging member having a first end and a second end, the second end having a first opening therein and a pair of boot gripping arms on opposite sides of said first opening, said first boot engaging member having a bottom portion with a first frame and an upright support cavity in said first frame;

a second boot engaging member having a first end and a second end, the second end having a second opening therein and a pair of boot gripping arms on opposite sides of said second opening, said second boot engaging member has a bottom portion with a second frame and an upright support and first frame cavity in said second frame; and an upright support hinged to the first ends of said first and second boot engaging members for folding the boot jack in half, said upright support acts as a fulcrum for pivoting the boot jack and holding the first and second boot engaging members at an angle from the horizontal;

said upright support cavity used for receiving said upright support therein when the boot jack is folded in half, said upright support and first frame cavity used for receiving said upright support and said first frame therein in a nesting relationship when the boot jack is folded in half.

2. The boot jack as described in claim 1 wherein said first opening is "V" shaped and said second opening is "V" shaped, said openings receiving a portion of a rear of a boot therein, said second "V" shaped opening smaller than said first "V" shaped opening for receiving smaller size boots.

3. The boot jack as described in claim 1 wherein said first opening is "U" shaped and said second opening is "U" shaped, said openings receiving a portion of a rear of a boot therein, said second "U" shaped opening smaller than said first "U" shaped opening for receiving smaller size boots.

4. A boot jack for removing different size boots and other footware, the boot jack comprising:

a first boot engaging member having a first end and a second end, the second end having a first opening therein and a pair of boot gripping arms on opposite sides of said first opening;

a second boot engaging member having a first end and a second end, the second end having a second opening therein and a pair of boot gripping arms on opposite sides of said second opening; and an upright support attached to the first ends of said first and second boot engaging members, said upright support acts as a fulcrum for pivoting the boot jack and holding the first and second boot engaging members at an angle from the horizontal, said upright support includes an upper portion which is hinged to the first ends of said first and second boot engaging members, said upright support and said first boot engaging member foldable into said second boot engaging member in a compact nesting relationship.

5. The boot jack as described in claim 4 wherein said first opening is larger than said second opening.

6. The boot jack as described in claim 4 wherein said first boot engaging member has a bottom portion with a first frame and an upright support cavity in said first frame, said upright support cavity used for receiving said upright support therein when the boot jack is folded in half.

7. The boot jack as described in claim 6 wherein said second boot engaging member has a bottom portion with a second frame and an upright support and first frame cavity in said second frame, said upright support and first frame cavity used for receiving said upright support and said first frame therein in a nesting relationship when the boot jack is folded in half.

8. A portable foldable boot jack for removing different size boots and other footware, the boot jack comprising:

a first boot engaging member having a first end and a second end, the second end having a first opening therein and a pair of boot gripping arms on opposite sides of said first opening;

a second boot engaging member having a first end and a second end, the second end having a second opening therein and a pair of boot gripping arms on opposite sides of said second opening; and an upright support hinged to the first ends of said first and second boot engaging members for folding the boot jack in half, said upright support acts as a fulcrum for pivoting the boot jack and holding the first and second boot engaging members at an angle from the horizontal, said second boot engaging member having a cavity in the bottom thereof, said upright support and said first boot engaging member foldable into said cavity of said second boot engaging member in a compact nesting relationship.

9. The boot jack as described in claim 8 wherein said first opening is "V" shaped and said second opening is "V" shaped, said openings receiving a portion of a rear of a boot therein, said second "V" shaped opening smaller than said first "V" shaped opening for receiving smaller size boots.

10. The boot jack as described in claim 8 wherein said first opening is "U" shaped and said second opening is "U" shaped, said openings receiving a portion of a rear of a boot therein, said second "U" shaped opening smaller than said first "U" shaped opening for receiving smaller size boots.

11. The boot jack as described in claim 8 wherein said first boot engaging member has a bottom portion with a first frame and an upright support cavity in said first frame, said upright support cavity used for receiving said upright support therein when the boot jack is folded in half.

12. The boot jack as described in claim 11 wherein said second boot engaging member has a bottom portion with a second frame and an upright support and first frame cavity in said second frame, said upright support and first frame cavity used for receiving said upright support and said first frame therein in a nesting relationship when the boot jack is folded in half.

* * * * *